US009791224B1

(12) United States Patent
Russo

(10) Patent No.: US 9,791,224 B1
(45) Date of Patent: Oct. 17, 2017

(54) FIREARM BOLT CARRIER

(71) Applicant: Carmelo Russo, Port Richey, FL (US)

(72) Inventor: Carmelo Russo, Port Richey, FL (US)

( * ) Notice: Subject to any disclaimer, the term of this patent is extended or adjusted under 35 U.S.C. 154(b) by 0 days.

(21) Appl. No.: 15/456,954

(22) Filed: Mar. 13, 2017

(51) Int. Cl.
*F41A 3/66* (2006.01)
*F41A 3/12* (2006.01)

(52) U.S. Cl.
CPC . *F41A 3/66* (2013.01); *F41A 3/12* (2013.01)

(58) Field of Classification Search
CPC ..... F41A 3/44; F41A 3/46
USPC ..... 42/16; 89/180, 188, 37.14
See application file for complete search history.

(56) References Cited

U.S. PATENT DOCUMENTS 1,780,521 A * 11/1930 Garand ..... F41A 19/34 42/16
3,407,702 A * 10/1968 Cermak ..... F41A 3/26 89/185
3,636,648 A * 1/1972 Spencer ..... F41A 19/13 42/16
4,232,583 A * 11/1980 Harrison ..... F41A 3/44 89/153
4,345,505 A * 8/1982 Patenaude ..... F41A 3/38 89/12
4,922,640 A * 5/1990 Toombs ..... F41B 11/00 42/16
4,930,399 A * 6/1990 Trevor, Jr. ..... F41A 3/46 89/185
5,726,376 A * 3/1998 Menges ..... F41A 17/76 42/70.08
2008/0236379 A1* 10/2008 Steimke ..... F41A 3/26 89/132

OTHER PUBLICATIONS

RedWolf Airsoft, G&P GBB Roller Bolt Carrier Set B, Date unkown, internet publication, found here: https://www.redwolfairsoft.com/redwolf/airsoft/Accessories_GBB_Bolt_Carriers_Related_Parts_G_P_GBB_Roller_Bolt_Carrier_Set_B_Negative_Pressure_for_Bomber_GBB_CNC_Metal_Body.htm; only first page and an expanded picture.*

* cited by examiner

*Primary Examiner* — Bret Hayes
(74) *Attorney, Agent, or Firm* — Gulf Coast Intellectual Property Group

(57) ABSTRACT

A bolt carrier for a firearm that includes a rolling element so as to provide improved alignment and reduced friction of the bolt carrier with the upper assembly and buffer tube as the bolt carrier executes a reciprocating motion. The bolt carrier includes a body that is generally cylindrical in shape having a first end and a second end. The body of the bolt carrier includes a first slot and a second slot. The first slot includes an upper opening and a lower opening. The second slot is proximate the second end of the body of the bolt carrier. The second slot includes an upper opening and a lower opening providing access to the interior volume of the second slot. A wheel is rotatably mounted within the second slot. The upper edge and lower edge of the wheel extends beyond the top side and bottom side of the body respectively.

19 Claims, 2 Drawing Sheets

FIREARM BOLT CARRIER

FIELD OF THE INVENTION

The present invention relates generally to firearms, more specifically but not by way of limitation, a bolt carrier for a gas operated automatic or semi-automatic firearm that further includes a wheel or similar structure that provides both improved alignment of the bolt carrier within the receiver and buffer tube and generally smoother operation.

BACKGROUND

Rifles such as but not limited to M16's and AR-15's can be configured in both automatic and semi-automatic configurations wherein these types of rifles are capable of firing a high capacity of ammunition rounds in short time periods. A critical component to these types of firearms is what is commonly known as a bolt carrier assembly. A conventional bolt carrier assembly includes elements such as but not limited to a bolt carrier, a bolt, a firing pin and a cam pin. Bolt carriers are generally cylindrical in shape having a bore throughout its length and further includes an opening on the top and bottom so as to permit a hammer to extend into the interior of the bolt carrier and strike the firing pin. The exterior of the bolt carrier is typically configured with a plurality of lands that are raised portions of the surface of the bolt carrier and function to engage the interior surface of the upper receiver in order to provide alignment.

One problem with conventional bolt carriers is the conventional configuration of lands requires some degree of spacing tolerance in order to permit the bolt carrier to execute a reciprocating motion within the upper receiver. During use of the firearm the bolt carrier will reciprocate within the the upper receiver as subsequent rounds of ammunition are loaded and fired. As the bolt carrier reciprocates a portion thereof will extend into a buffer tube, which is a tube located in the stock of the gun having a hollow passage permitting the bolt carrier to travel the required distance. Alignment of the buffer tube with the upper receiver is critical. The combination of aforementioned space tolerances and vibrations that occur during firing of a round of ammunition can create a less than desirable action of the bolt carrier. In some cases the bolt carrier can improperly engage the interior surface of the buffer tube resulting in poor performance of the firearm.

Accordingly, there is a need for a bolt carrier that is configured to provide a reduced friction with the upper receiver and further provide improved alignment within the upper receiver and buffer tube.

SUMMARY OF THE INVENTION

It is the object of the present invention to provide a bolt carrier that is configured to provide a reciprocating motion with reduced friction wherein the bolt carrier includes a body that is generally cylindrical in shape.

Another object of the present invention is to provide a bolt carrier configured to provide improved alignment within the upper receiver and buffer tube wherein the bolt carrier includes a first slot having an opening on the bottom side and top side of the slot providing access thereto.

A further object of the present invention is to provide a bolt carrier that is configured to provide a reduced friction reciprocating motion wherein the body of the bolt carrier includes a first end and a second end.

An additional object of the present invention is to provide a bolt carrier configured to provide improved alignment within the upper receiver and buffer tube wherein the body includes a second slot.

Yet a further object of the present invention is to provide a bolt carrier that is configured to provide a reduced friction reciprocating motion wherein the second slot extends through the body having an opening on the top side and bottom side of the body.

A further object of the present invention is to provide a bolt carrier configured to provide improved alignment within the upper receiver and buffer tube that further includes a wheel or similar structure disposed within the second slot of the body.

Another object of the present invention is to provide a bolt carrier that is configured to provide a reduced friction reciprocating motion wherein the upper edge and lower edge of the wheel extend beyond the exterior surface of the body of the bolt carrier.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
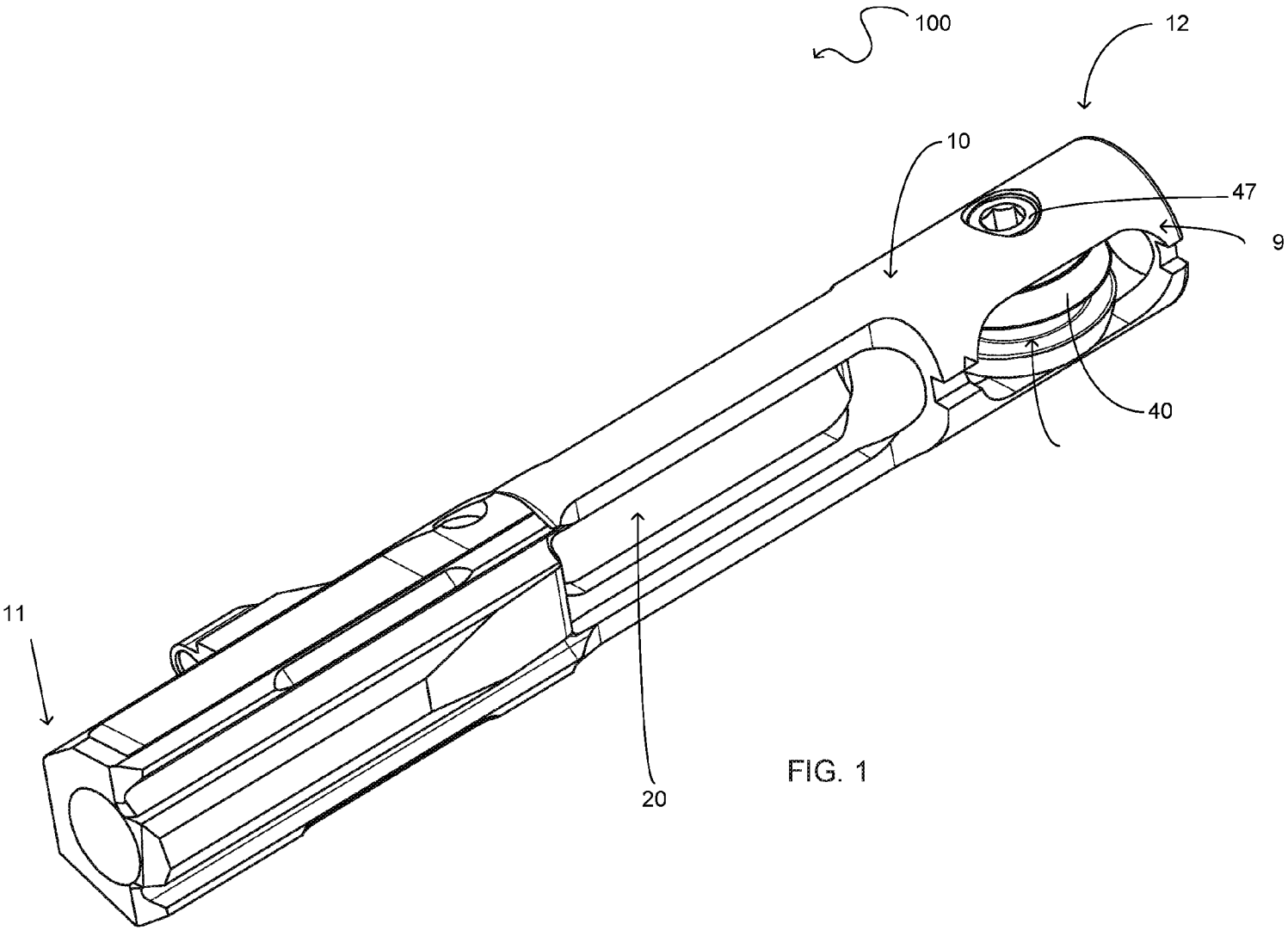
FIG. 1 is a bottom perspective view of the present invention.

Referring now to the drawings submitted herewith, wherein various elements depicted therein are not necessarily drawn to scale and wherein through the views and figures like elements are referenced with identical reference numerals, there is illustrated a bolt carrier 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
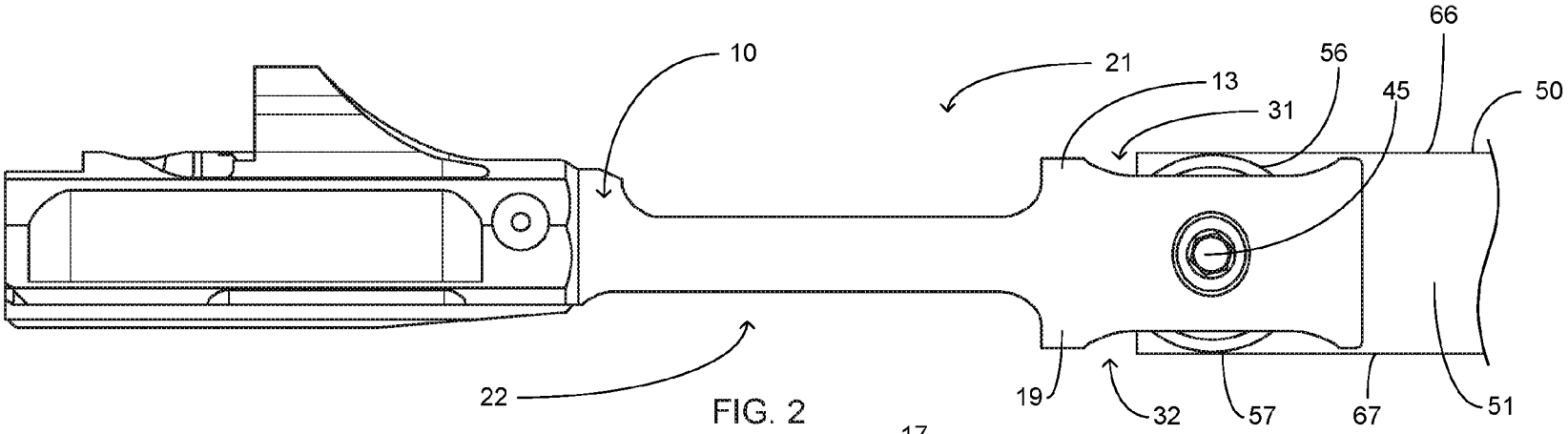
FIG. 2 is a side view of the present invention.
Figure 3:
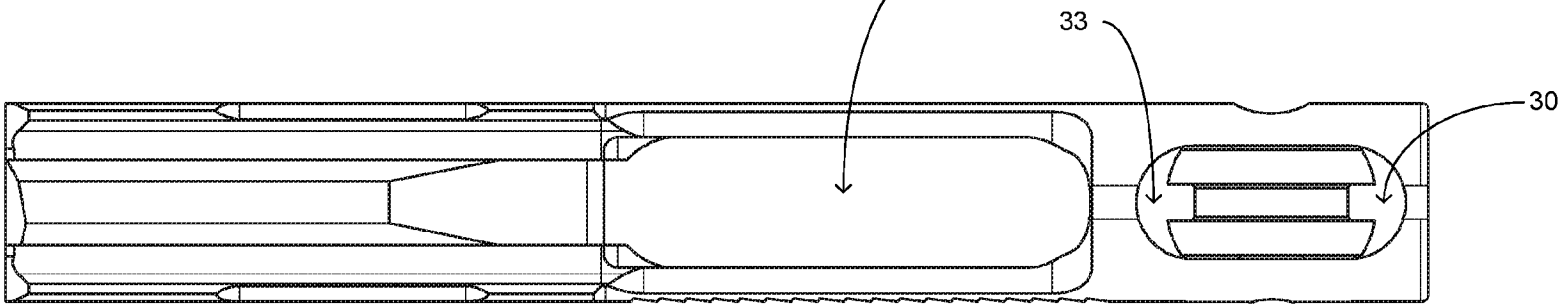
FIG. 3 is a bottom view of the present invention.

Referring in particular to FIGS. 1 and 2, the bolt carrier 100 includes body 10. Body 10 is manufactured from a durable material such as but not limited to metal. Body 10 is substantially cylindrical in shape having a first end 11 and second end 12. While not illustrated herein, it should be understood within the scope of the present invention that the bolt carrier 100 is positioned inside an upper receiver (not shown) of a firearm such as but not limited to an AR-15 wherein the first end 11 is proximate the barrel of the firearm.

The body 10 includes first slot 20 that is journaled therethrough. Slot 20 includes first opening 21 on the top side 18 and second opening 22 located on the bottom side 19. The first opening 21 and second opening 22 provide access to the interior volume 17 of the first slot 20 and as such the body 10. The first slot 20 is oval in shape and is configured to be of suitable size so as to allow clearance for a hammer therein so as to provide striking of the firing pin. It should be understood within the scope of the present invention that the first slot 20 could be manufactured in alternate lengths and/or widths in order to accomplished the aforementioned.

Proximate to the second end 12 of the body 10 is a second slot 30. Second slot 30 is journaled through the body 10 and includes a first opening 31 on the top side 18 and a second opening 32 on the bottom side 19. Second slot 30 extends through the body 10 having an interior volume 33. The second slot 30 is oval in shape and is manufactured of suitable size so as to accommodate wheel 40 therein. It is contemplated within the scope of the present invention that the second slot 30 could be formed in alternate shapes and/or sizes so as to accommodate a wheel 40 having different diameters or widths. The second slot 30 is formed in the body 10 proximate the second end 12 so as to be proximate the buffer tube 50. As is further discussed herein the wheel 40 mounted within the second slot 30 provides improved alignment within an upper receiver of a firearm and further ensures a smooth reciprocating motion as a portion of the body 10 travels into the buffer tube passage 51.

Rotatably mounted within the second slot 30 is wheel 40. Wheel 40 is annular in shape and is manufactured from a durable material such as but not limited to metal. The wheel 40 is rotatably secured within the second slot 30 utilizing axle 45. Axle 45 is manufactured from a suitable durable material such as but not limited to a metal rod and is secured to the body using keep 47. The wheel 40 is rotatable around the axle 45. The wheel 40 includes groove 52. Groove 52 is formed to engage a projection or similar structure within an upper receiver of a firearm or the buffer tube 52. The groove 52 is circumferentially disposed on the wheel 40. The aforementioned configuration inhibits any rotational movement of the body 10 during reciprocating movements thereof during the firing process. The groove 52 further promotes reduced vibration movement effects when engaged with a projection. While the wheel 40 is illustrated herein as having a groove 52, it is contemplated within the scope of the present invention that the wheel 50 could be formed without a groove 52. Furthermore, it is contemplated within the scope of the present invention that the alternate rolling means could be utilized in place of the wheel 40. By way of example but not limitation, a ball or other similar structure could provide the functionality discussed herein of the wheel 40.

The wheel 52 includes upper edge 56 and lower edge 57 that are configured to engage the upper wall 66 and lower wall 67 of the buffer tube 50. The upper edge 56 extends slightly above the top side 18 while the lower edge 57 of the wheel 40 extends slightly beyond the bottom side 19. It is contemplated within the scope of the present invention that the distance in which the upper edge 56 and lower edge 57 extend beyond the exterior surface 9 of the body 10 could vary depending upon parameters such as but not limited to firearm configuration. The upper edge 56 and lower edge 57 of the wheel 40 are axially aligned with upper wall 66 and lower wall 67 respectively. The aforementioned axial alignment promotes an uninterrupted an smooth travel of the bolt carrier 100 during reciprocal movements thereof during firing of a firearm in which the bolt carrier 100 is mounted. The wheel 40 and its alignment described herein inhibit any vibrational movements that may allow the body 10 to move off-axis and as such ensure a smooth travel within the buffer tube 40.

While one wheel 40 is discussed and illustrated herein, it is contemplated within the scope of the present invention that the second slot 30 could have more than one wheel 40 disposed therein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bolt carrier for a firearm comprising:

a body, said body being elongated and generally cylindrical in shape, said body having a first end and a second end, said body including a first slot, said first slot being journaled through said body intermediate a top side and a bottom side, said first slot having a first opening and a second opening;

a second slot, said second slot being proximate said second end of said body, said second slot being journaled through said body intermediate said top side and said bottom side, said second slot being intermediate said second end of said body and said first slot;

a rolling means, said rolling means being disposed within said second slot, said rolling means having an upper edge and a lower edge, said rolling means configured to provide axial alignment with the bolt carrier and a buffer tube within a firearm wherein the rolling means further provides a reduced friction reciprocating movement of the bolt carrier.

2. The bolt carrier as recited in claim 1, wherein said upper edge of said rolling means extends beyond said top side of said body.

3. The bolt carrier as recited in claim 2, wherein said lower edge of said rolling means extends beyond said bottom side of said body.

4. The bolt carrier as recited in claim 3, wherein said second slot includes a first opening, said first opening being proximate said top side of said body.

5. The bolt carrier as recited in claim 4, and further including an axle, said axle configured to rotatably mount said rolling means within said second slot.

6. The bolt carrier as recited in claim 5, wherein said second slot include a second opening, said second opening being proximate said bottom side of said body.

7. A bolt carrier for a firearm comprising:

a body, said body being elongated and generally cylindrical in shape, said body having a first end and a second end, said body including a first slot, said first slot being journaled through said body intermediate a top side and a bottom side, said first slot having a first opening and a second opening, said first slot being oval in shape;

a second slot, said second slot being proximate said second end of said body, said second slot being journaled through said body intermediate said top side and said bottom side, said second slot being intermediate said second end of said body and said first slot, said second slot being oval in shape;

at least one wheel, said at least one wheel being disposed within said second slot, said at least one wheel having an upper edge and a lower edge, said at least one wheel being rotatably mounted within said second slot, said at least one wheel configured to provide axial alignment amongst the bolt carrier and a buffer tube within a firearm wherein the at least one wheel further provides a reduced friction reciprocating movement of the bolt carrier.

8. The bolt carrier as recited in claim 7, wherein said second slot further includes a first opening, said first opening of said second slot being proximate said top side of said body.

9. The bolt carrier as recited in claim 8, wherein said second slot further includes a second opening, said second opening of said second slot is proximate said bottom side of said body.

10. The bolt carrier as recited in claim 9, and further including an axle, said axle configured to rotatably mount said at least one wheel, said axle configured to extend intermediate opposing sides of said body of the bolt carrier.

11. The bolt carrier as recited in claim 10, wherein said at least one wheel further includes a lower edge, said lower edge of said at least one wheel is configured to extend beyond said bottom side of said body.

12. The bolt carrier as recited in claim 11, wherein said at least one wheel further includes an upper edge said upper edge of said at least one wheel being configured to extend beyond said top side of said body.

13. A bolt carrier for a firearm comprising:

a body, said body being elongated and generally cylindrical in shape, said body having a first end and a second end, said body including a first slot, said first slot being journaled through said body intermediate a top side and a bottom side, said first slot having a first opening and a second opening, said first slot being oval in shape;

a second slot, said second slot being proximate said second end of said body, said second slot being journaled through said body intermediate said top side and said bottom side, said second slot being intermediate said second end of said body and said first slot, said second slot being oval in shape;

a wheel, said wheel being disposed within said second slot, said wheel having an upper edge and a lower edge, said wheel being rotatably mounted within said second slot, said wheel configured to provide axial alignment amongst the bolt carrier and a buffer tube within a firearm wherein the wheel further provides a reduced friction reciprocating movement of the bolt carrier; and an axle, said axle configured to rotatably mount said wheel, said axle configured to extend intermediate opposing sides of said body.

14. The bolt carrier as recited in claim 13, wherein said second slot further includes a first opening, said first opening of said second slot being proximate said top side of said body.

15. The bolt carrier as recited in claim 14, wherein said second slot further includes a second opening, said second opening of said second slot is proximate said bottom side of said body.

16. The bolt carrier as recited in claim 15, wherein the wheel further includes a groove, said groove being circumferentially disposed on said wheel.

17. The bolt carrier as recited in claim 16, wherein said wheel further includes a lower edge, said lower edge of said at least one wheel is configured to extend beyond said bottom side of said body.

18. The bolt carrier as recited 17, in claim wherein said wheel further includes an upper edge said upper edge of said at least one wheel being configured to extend beyond said top side of said body.

19. The bolt carrier as recited 18, wherein said wheel further includes a groove, said groove being circumferentially disposed on said wheel.

* * * * *